US008795085B2

(12) United States Patent
Kryger

(10) Patent No.: US 8,795,085 B2
(45) Date of Patent: Aug. 5, 2014

(54) METHODS, SYSTEMS, AND COMPUTER PROGRAMS FOR CREATING AND SCORING GOLF ROUNDS AND SIDE GAMES

(76) Inventor: Kyle Walter Kryger, Kansas City, MO (US)

( * ) Notice: Subject to any disclaimer, the term of this patent is extended or adjusted under 35 U.S.C. 154(b) by 1074 days.

(21) Appl. No.: 12/420,939

(22) Filed: Apr. 9, 2009

(65) Prior Publication Data

US 2010/0261533 A1 Oct. 14, 2010

(51) Int. Cl.
*A63F 13/533* (2014.01)
*A63B 71/06* (2006.01)

(52) U.S. Cl.
CPC ..... *A63B 71/0669* (2013.01); *A63B 2071/0661* (2013.01); *A63B 2243/0029* (2013.01); *A63B 71/0616* (2013.01); *A63B 2225/20* (2013.01)
USPC ..... 463/42; 700/91; 700/92

(58) Field of Classification Search
USPC ..... 463/42, 43; 700/91, 92
See application file for complete search history.

(56) References Cited

U.S. PATENT DOCUMENTS

| | | | | |
|---|---|---|---|---|
| 4,367,526 | A * | 1/1983 | McGeary et al. | 377/5 |
| 7,549,918 | B2 * | 6/2009 | Kang et al. | 463/3 |
| 2001/0051835 | A1 * | 12/2001 | Cline | 700/91 |
| 2005/0096761 | A1 * | 5/2005 | Hanover et al. | 700/92 |
| 2008/0108456 | A1 * | 5/2008 | Bonito | 473/409 |
| 2008/0167737 | A1 * | 7/2008 | Schmidt | 700/92 |

FOREIGN PATENT DOCUMENTS

WO WO 9640387 A1 * 12/1996 ..... A63B 57/00

* cited by examiner

*Primary Examiner* — Bach Hoang
(74) *Attorney, Agent, or Firm* — Hovey Williams LLP

(57) ABSTRACT

A computer readable medium having a computer program stored thereon for operating a computer system to track golf scores and side games. The computer program may comprise a code segment for receiving with the computer system course information and player information for a round of golf; a code segment for receiving with the computer system side game information for side games to be played by players of the round of golf; a code segment for receiving with the computer system scoring information for the players as they play the round of golf; and a code segment for scoring with the computer system the round of golf and calculating results of the side games based at least partially on the player information and the scoring information.

20 Claims, 14 Drawing Sheets

Round Results

Course Name : Blue Hills Country Club [Edit Round]

Round Name :

Round Date : 11/11/2008

Enter Scores

| # | Hole | 1 | 2 | 3 | 4 | 5 | 6 | 7 | 8 | 9 | Out | 10 | 11 | 12 | 13 | 14 | 15 | 16 | 17 | 18 | In | Total | Hdcp | Net | Locked |
|---|---|---|---|---|---|---|---|---|---|---|---|---|---|---|---|---|---|---|---|---|---|---|---|---|---|
| | Par | 5 | 4 | 4 | 4 | 3 | 5 | 4 | 3 | 4 | 36 | 4 | 4 | 3 | 5 | 3 | 4 | 4 | 4 | 5 | 36 | 72 | | | |
| | Name/Hdcp | 11 | 9 | 5 | 1 | 17 | 3 | 15 | 13 | 7 | | 12 | 14 | 16 | 6 | 18 | 2 | 4 | 8 | 10 | | | | | |
| 1 | JGolfer / 11 | 5 | 6 | 6 | 6 | 3 | 5 | 5 | 3 | 4 | 43 | 4 | 4 | 4 | 5 | 3 | 5 | 4 | 4 | 5 | 38 | 81 | 11 | 70 | |
| 2 | strap / 15 | 6 | 4 | 4 | 4 | 4 | 6 | 4 | 3 | 5 | 40 | 4 | 4 | 4 | 6 | 4 | 6 | 5 | 5 | 5 | 43 | 83 | 15 | 68 | |
| 3 | ASmith / 17 | 6 | 6 | 6 | 6 | 5 | 6 | 5 | 3 | 5 | 48 | 5 | 5 | 3 | 5 | 4 | 5 | 4 | 4 | 7 | 42 | 90 | 17 | 73 | |
| 4 | BJones / 7 | 6 | 6 | 6 | 6 | 4 | 5 | 5 | 3 | 6 | 47 | 4 | 5 | 4 | 6 | 3 | 6 | 5 | 5 | 6 | 44 | 91 | 7 | 84 | |
| 5 | TPutt / 10 | 6 | 6 | 6 | 6 | 3 | 6 | 5 | 3 | 5 | 46 | 4 | 5 | 4 | 6 | 4 | 6 | 5 | 5 | 5 | 44 | 90 | 10 | 80 | |

| Game | TPutt | strap | BJones | ASmith | JGolfer |
|---|---|---|---|---|---|
| Spin Off-Match Play x 5-Per Player | 5.00 | 5.00 | -5.00 | -5.00 | |
| Net-Skins x 1-Per Player | -12.00 | 28.00 | -12.00 | -7.00 | 3.00 |
| | -7.00 | 33.00 | -17.00 | -12.00 | 3.00 |

Spin Off-Match Play x 5-Per Player [Show Details]

| # | Hole | 1 | 2 | 3 | 4 | 5 | 6 | 7 | 8 | 9 | 10 | 11 | 12 | 13 | 14 | 15 | 16 | 17 | 18 | Points | Total |
|---|---|---|---|---|---|---|---|---|---|---|---|---|---|---|---|---|---|---|---|---|---|
| | Par | 5 | 4 | 4 | 4 | 3 | 5 | 4 | 3 | 4 | 4 | 4 | 3 | 5 | 3 | 4 | 4 | 4 | 5 | | |
| | Name/Hdcp | 11 | 9 | 5 | 1 | 17 | 3 | 15 | 13 | 7 | 12 | 14 | 16 | 6 | 18 | 2 | 4 | 8 | 10 | | |
| 1 | TPutt/strap vs BJones/ASmith | 0 | 1 | 2 | 3 | 4 | 4 | 5 | 5 | 5 | 0 | 1 | 0 | (1) | (2) | (3) | (4) | (5) | (4) | | 0.00 |
| 2 | Press on #3 (A) | | | | 1 | 2 | 2 | 3 | 3 | 3 | | | | | | | | | | | 10.00 |
| 3 | Press on #5 (A) | | | | | | 0 | 1 | 1 | 1 | | | | | | | | | | | 10.00 |
| 4 | Press on #14 (A) | | | | | | | | | | | | | | | (1) | (2) | (3) | (2) | | 10.00 |
| 5 | Press on #16 (A) | | | | | | | | | | | | | | | | | (1) | 0 | | 0.00 |

Net-Skins x 1-Per Player [Show Details]

| # | Hole | 1 | 2 | 3 | 4 | 5 | 6 | 7 | 8 | 9 | 10 | 11 | 12 | 13 | 14 | 15 | 16 | 17 | 18 | Points | Total |
|---|---|---|---|---|---|---|---|---|---|---|---|---|---|---|---|---|---|---|---|---|---|
| | Par | 5 | 4 | 4 | 4 | 3 | 5 | 4 | 3 | 4 | 4 | 4 | 3 | 5 | 3 | 4 | 4 | 4 | 5 | | |
| | Name/Hdcp | 11 | 9 | 5 | 1 | 17 | 3 | 15 | 13 | 7 | 12 | 14 | 16 | 6 | 18 | 2 | 4 | 8 | 10 | | |
| | Score | 4 | 3 | 3 | 3 | | | 3 | | 3 | 3 | 3 | 2 | | | | | | | | |
| 1 | strap | | 1 | 1 | 1 | | | 3 | | | 1 | 1 | | | | | | | | 8 | 28.00 |
| 2 | JGolfer | 1 | | | | | | | | 2 | | | | | | | | | | 3 | 3.00 |
| 3 | ASmith | | | | | | | | | | | | 1 | | | | | | | 1 | -7.00 |

1900

1902

Fig. 19

2400

Scores and Statistics

Enter a start and end date to get your shot count, per hole score, and other statistics.

Start Date 2/5/2009 End Date 4/6/2009 Get Stats

Your Shot Disturbtion

Click on a heading below to see the courses and scores associated with that type of shot.

| Type: | Birdie | Par | Bogey | Double | Quadruple |
|---|---|---|---|---|---|
| Count: | 5 | 14 | 15 | 8 | 3 |

Your per hole Birdie scores.

| CourseName | RoundName | Played | TeeColor | Hole | Handicap | Par | Distance |
|---|---|---|---|---|---|---|---|
| Troon North Golf Club - Monument | Troon North - Spring Break | 3/18/2009 | Silver | 13 | 18 | 3 | 196 |
| Troon North Golf Club - Monument | Troon North - Spring Break | 3/18/2009 | Silver | 16 | 16 | 3 | 222 |
| Blue Hills Country Club | | 4/4/2009 | Members | 1 | 11 | 5 | 513 |
| Blue Hills Country Club | | 4/4/2009 | Members | 8 | 13 | 3 | 195 |
| Coronado Golf Course | Cory Sam dad | 3/16/2009 | Blue | 9 | 7 | 4 | 261 |

Fig. 24

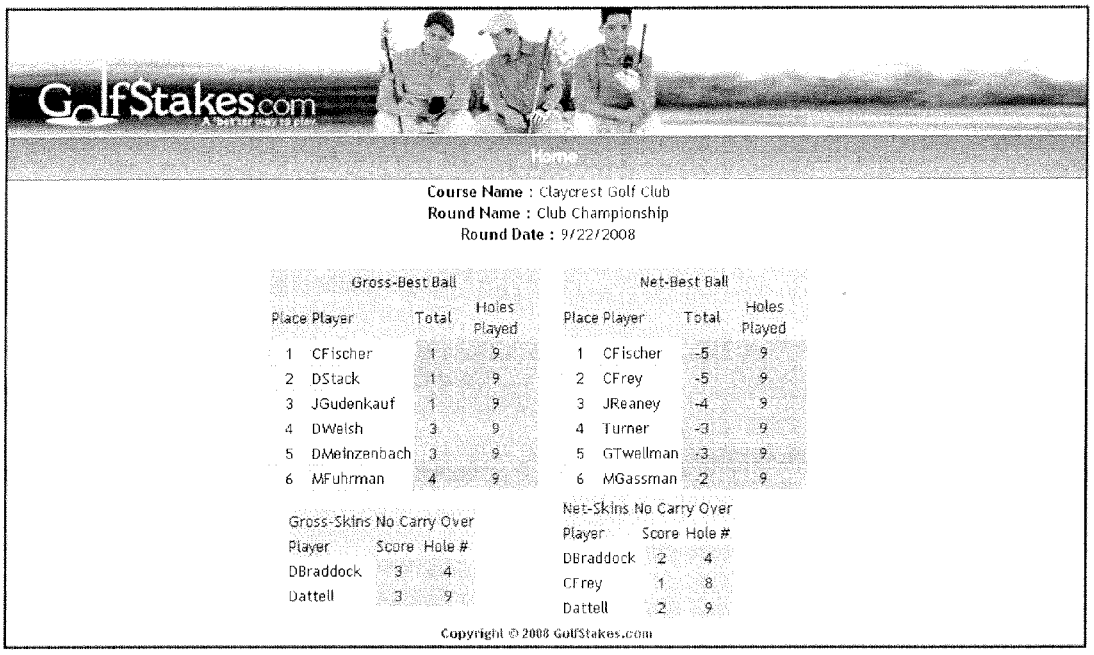

Fig. 25

METHODS, SYSTEMS, AND COMPUTER PROGRAMS FOR CREATING AND SCORING GOLF ROUNDS AND SIDE GAMES

BACKGROUND

The present invention relates to golf scoring and side games. More particularly, embodiments of the invention relate to methods, systems, and computer programs for creating, scoring, and tracking golf rounds and side games.

Golfers often play in tournaments, leagues, or private groups and also participate in numerous "side games" between players in their group or even among players in other groups. Scoring the primary round of golf and keeping track of all of the side games can be time-consuming and error-prone and often slows the pace of play.

Devices have been developed for tracking golf scores, but they are difficult to use, require dedicated hardware, and/or lack functionality. Moreover, known golf scoring devices cannot be used to quickly and easily add a group or groups to a round, add multiple players within a group, enter scores for multiple players at the same time, and/or score multiple side games during a round of golf.

SUMMARY

The present invention provides a distinct advance in the art of golf scoring. More particularly, embodiments of the present invention allow golfers to more quickly and easily create, score, and track a round of golf and any number of side games.

The present invention allows a golfer or other user to access a website or other computer-implemented service with a mobile phone or computer and set up a round of golf at a desired golf course with any playing partners. The user may then create virtually any side games between the playing partners and/or other groups of golfers. Once the round and side games have been saved and the golfers begin playing the round, one person in the group may access the website or other computer-implemented service with a web-enabled cell phone or other mobile device and enter scores. Alternatively, scores may be entered after the round is complete. The website or other computer-implemented service automatically scores the round as well as the side games and allows anyone with a web-enabled computer or cell phone to access nearly live scoring of the round and side games. Multiple groups (e.g. foursomes or any other number of players) of players may use the present invention to create and score a tournament or league and track the scores and side games of all of the players in the various groups. The invention even provides a virtual "leader board" that can be accessed by anyone with a web-enabled computer or cell phone that provides every player's score and updated results of the side games.

One particular embodiment of the invention is implemented with a computer readable medium having a computer program stored thereon for operating a computer system to track golf scores and side games. The computer program may comprise: a code segment for receiving with the computer system course information and player information for a round of golf; a code segment for receiving with the computer system side game information for side games to be played by players of the round of golf; a code segment for receiving with the computer system scoring information for the players as they play the round of golf or after they have finished the round; and a code segment for scoring with the computer system the round of golf and calculating results of the side games based at least partially on the player information and the scoring information.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein:

FIG. 19 is another exemplary screen display that may be displayed by some of the equipment of FIG. 1;

FIG. 24 is another exemplary screen display that may be displayed by some of the equipment of FIG. 1; and FIG. 25 is another exemplary screen display that may be displayed by some of the equipment of FIG. 1.

Figure 1:
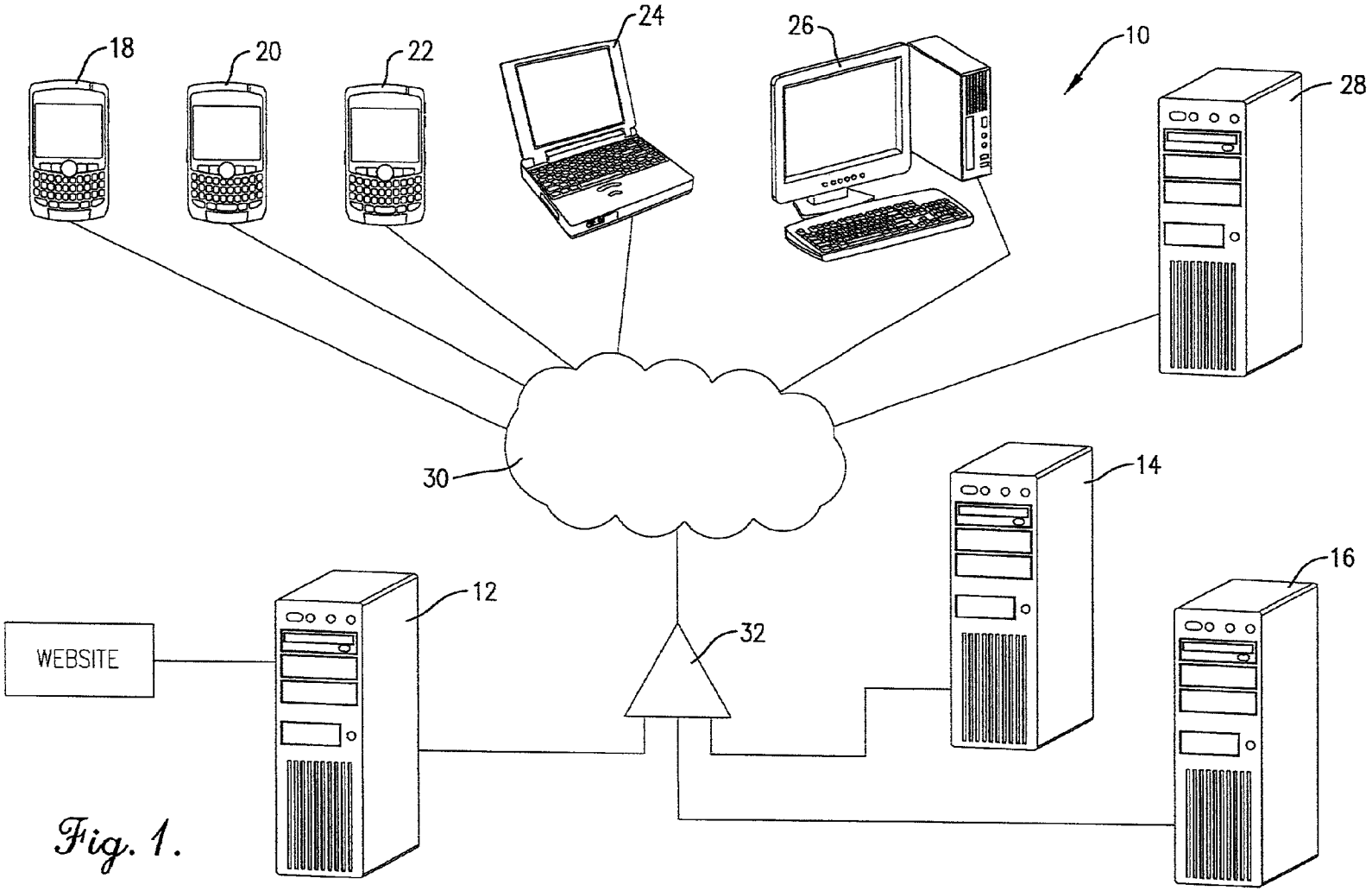
FIG. 1 is a schematic diagram of exemplary computer and communications equipment that may be used to implement certain aspects of the present invention.
Figure 2:
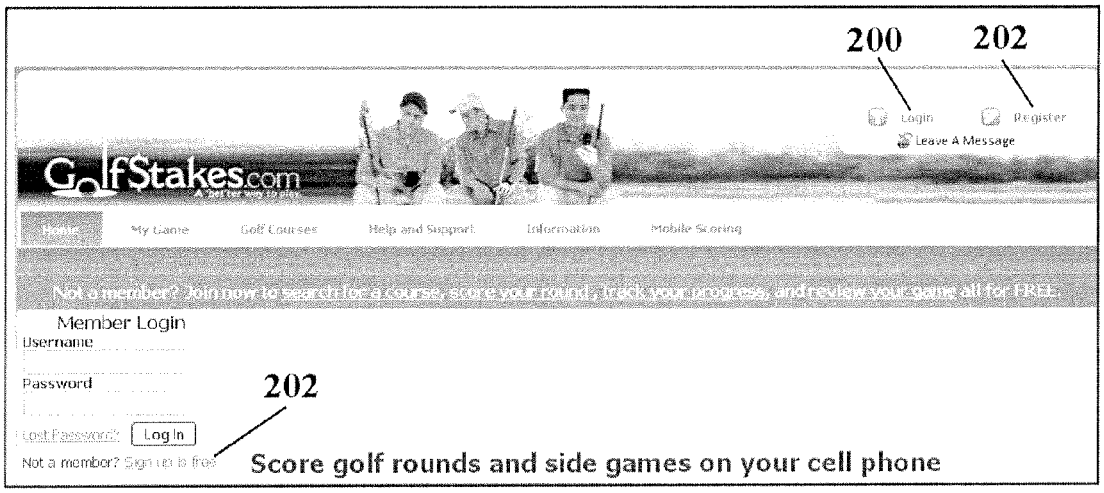
FIG. 2 is an exemplary screen display that may be displayed by some of the equipment of FIG. 1 when implementing certain aspects of the invention.
Figure 3:
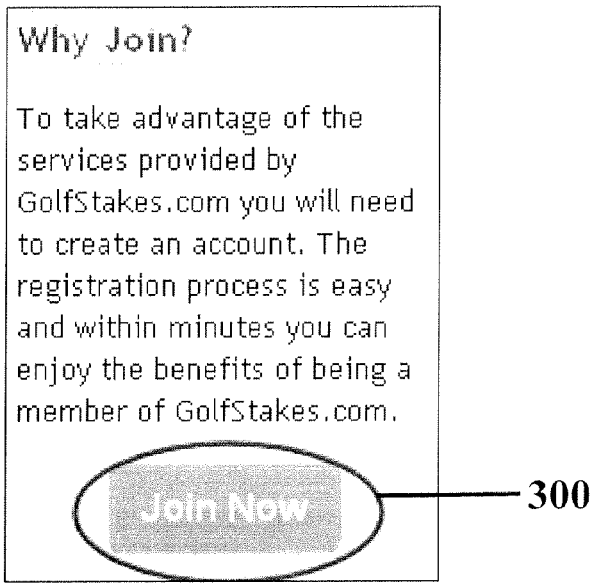
FIG. 3 is another exemplary screen display that may be displayed by some of the equipment of FIG. 1.
Figure 4:
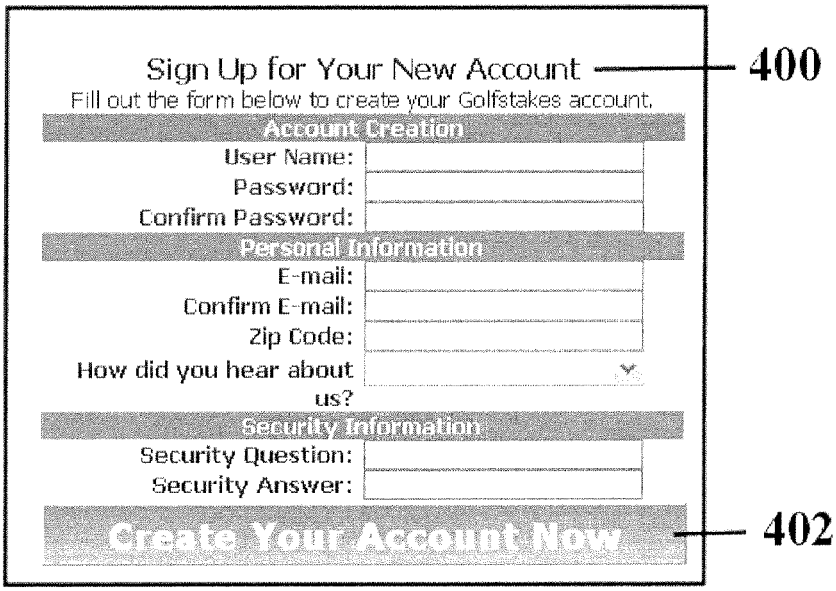
FIG. 4 is another exemplary screen display that may be displayed by some of the equipment of FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Embodiments of the present invention provide methods, systems, and computer programs that allow a golfer or other user to access a website or other computer-implemented service with a mobile phone or computer and set up a round of golf at a desired golf course with any playing partners. The user may then create virtually any side games between the playing partners and/or other groups of golfers. Once the round and side games have been saved and the golfers begin playing the round, one person in the group may access the website or other computer-implemented service with a web-enabled cell phone and enter scores. Alternatively, scores may be entered after the round is complete. The website or other computer-implemented service automatically scores the round as well as the side games as they are being played or afterwards and allows anyone with a web-enabled computer or cell phone to access nearly live scoring of the round and side games. Multiple groups (e.g. foursomes or other numbers of players) of players may use the present invention to create and score a tournament or league and track the scores and side games of all of the players in the various groups. The invention may even create a virtual "leader board" that can be accessed by anyone with a web-enabled computer or cell phone that provides every player's score and updated results of the side games. Other features and aspects of the invention are described in more detail below.

The invention can be implemented in hardware, software, firmware, or a combination thereof. In one exemplary embodiment, the invention is implemented with a computer program or programs that operate computer and communications equipment broadly referred to by the numeral 10 in FIG. 1. The exemplary computer and communications equipment 10 may include one or more host computers 12, 14, 16 and any number of electronic devices 18, 20, 22, 24, 26, 28 that may access one or more of the host computers via a communications network 30. The computer programs and equipment illustrated and described herein are merely examples of programs and equipment that may be used to implement embodiments of the invention and may be replaced with other programs and computer equipment without departing from the scope of the invention.

The host computers 12, 14, 16 may serve as repositories for data and programs used to implement certain aspects of the present invention as described in more detail below. The host computers 12, 14, 16 may be any computing devices such as network or server computers and may be connected to a firewall to prevent tampering with information stored on or accessible by the computers. The functionality of the host computers may also be distributed amongst many different computers in a cloud computing environment.

One of the host computers, such as host computer 12, may be a device that operates or hosts a website accessible by at least some, or all, of the devices 18-28. The host computer 12 includes conventional web hosting operating software, an Internet connection such as a cable connection, satellite connection, DSL converter, or ISDN converter, and is assigned a URL and corresponding domain name such as "www.golfstakes.com" and/or "mobile.golfstakes.com" so that the website hosted thereon can be accessed via the Internet in a conventional manner.

The host computers 14, 16 may be operated by entities that provide data or services to users of the host computer 12. For example, the host computer 14 may be operated by a golf course, handicapping service, etc. that provides golf course information, handicap information, etc. The host computer 16 may be operated by an advertisement placement company that provides targeted advertising and/or messages to users of the host computer.

Although three host computers 12, 14, 16 are described and illustrated herein, embodiments of the invention may use any combination of host computers and/or other computers or equipment. For example, the features and services described herein may be divided between the host computers 12, 14, 16 and other computers or may all be implemented with only one of the host computers.

The computer and communications equipment 10 may also include or use a data interchange format device 32 for distinguishing the types of devices (e.g. mobile phone, desktop computer) that attempt to access the host computers 12, 14, 16 and for routing communications and requests to the host computers accordingly.

The electronic devices 18-28 may be used by golfers, caddies, golf tournament organizers, and/or other users wishing to view, receive, and/or provide information described herein. The electronic devices 18-28 may be any types of devices that can access to the host computers 12, 14, 16 via the communications network 30. Each electronic device 18-28 preferably includes or can access a web browser and a conventional Internet connection such as a wireless broadband connection, a modem, DSL converter, or ISDN converter that permits it to access the Internet. Although FIG. 1 depicts a particular number of electronic devices 18-28, any number of devices may access the host computers 12, 14, 16.

The electronic devices 18-28 may include, for example, one or more mobile communications devices 18, 20, 22 such as wireless phones, phone-enabled personal digital assistants (PDAs) manufactured by or for Apple or Blackberry, MP3 devices, handheld game players, communication-enabled laser rangefinders, or any other wireless communication device. The devices are web-enabled and include a mobile browser or wireless Internet browser that can connect to the host computer 12 via the communications network 30. The devices 18-22 may also include a GPS chipset or other navigation technology to determine their location. Such mobile communication devices may be operated by golfers, caddies, or others while playing a round of golf as discussed in more detail below.

The electronic devices 18-28 may also include one or more laptop, personal, or network computers 24, 26, 28 that may be used by golfers or other users before or after a round of golf as described in more detail below.

The communications network 30 is preferably the Internet but may be any other communications network such as a local area network, a wide area network, a wireless network, or an intranet. The communications network 30 may also be a combination of several networks. For example, the electronic devices 18-28 may wirelessly communicate with a computer or hub in a store via a WiFi network, which in turn is in communication with one or more of the host computers 12, 14, 16 via the Internet or other communication network.

The computer programs of the present invention are stored in or on computer-readable medium residing on or accessible by the computer and communications equipment 10. The computer programs preferably comprise ordered listings of executable instructions for implementing logical functions in the host computers 12, 14, 16 and/or devices 18-28. For example, the computer programs may implement a website hosted on the host computer 12 that may be accessed by the devices 18-28.

The computer programs can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electromagnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

The following paragraphs describe features and functions of the invention with reference to the exemplary screen displays of FIGS. 2-23. The screen displays are merely examples and may be replaced with other screen displays without departing from the scope of the present invention. To create, score, and track a golf round and side games, a user creates an account with the host computer, creates a round of golf, adds one or more side games to the round, and then enters scores into the host computer via one of the mobile communication devices 18-22 or a similar device while playing the golf round or with one of the devices 18-22 or a computer after the round of golf is complete. The host computer scores and tracks the round of golf and all side games and presents useful information to the players and others. Each of these steps is described in more detail below.

Create Account

To create an account, a golfer or other user may access the host computer 12 with any of the devices 18-28 by navigating to a website hosted on the computer. For example, using a web browser, a golfer may navigate to www.golfstakes.com (or any other URL that points to the host computer) and be presented with a home page 200 similar to the one shown in FIG. 2. The first time the user accesses the website, he or she may be required to create a user account by clicking a "Register" or "Sign up is free" or similar link 202 shown in FIG. 2. The user may then be presented with a "Join Now" button or similar link 300 shown in FIG. 3, but this is optional. The user is then presented with a sign-up box or template 400 such as the one shown in FIG. 4 to enter conventional new account information such as a user name, password, e-mail address, and security question. Once the user has entered the sign-up information, he or she may press a "Create Your Account Now" button or link 402 and then be sent a verification e-mail with a link that confirms the account registration. Preferably, every person that wishes to have his or her golf rounds and side games scored and tracked must create a user account, but "guests" may also use the website as described below.

Create Round and Side Games

Figure 5:
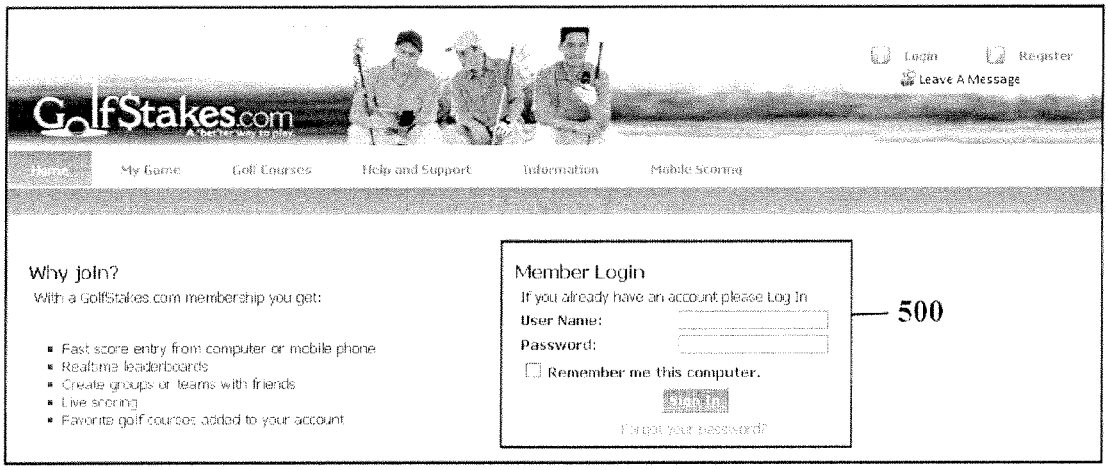
FIG. 5 is another exemplary screen display that may be displayed by some of the equipment of FIG. 1.

A registered user may create a round of golf and side games by again navigating to www.golfstakes.com and entering his or her user name and password in a log-in box or template 500 such as the one shown in FIG. 5. The round of golf may be set up ahead of time with one of the computers 24, 26, 28 or may be set up while the user is at the golf course with one of the mobile phones 18, 20, 22.

A registered user may create a round for personal, league, or tournament play compiled of players that do not have Golfstakes user accounts. The registered member can use the "Add a One Time Golfer" to add non registered players to a group or groups and then have Golfstakes.com assign a computer generated pin number to the group for scoring as a temporary user ID. The "One Time Golfers" will then be able to login into the system using a tournament ID (username) and the computer generated pin number (password) as a login ID and password. This information can be printed at the bottom of scorecard that the registered user has the option to print out along with a sheet showing each pin number for each group. This way, non members can login with a temporary user id and password to enter scores for the group they are part of to score rounds for personal, league, or tournament use.

Figure 6:
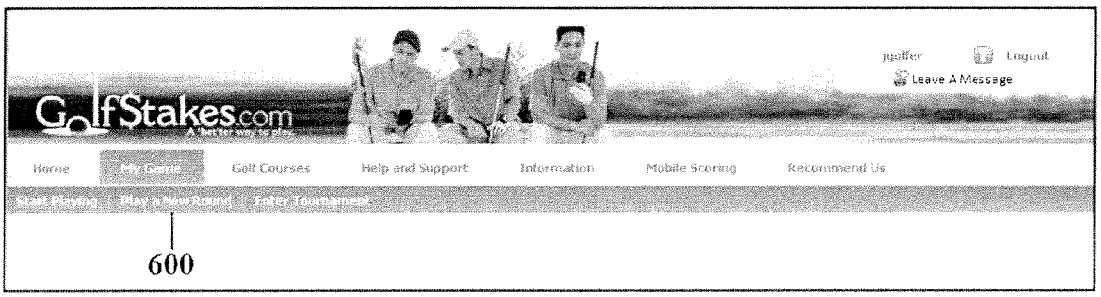
FIG. 6 is another exemplary screen display that may be displayed by some of the equipment of FIG. 1.
Figure 7:
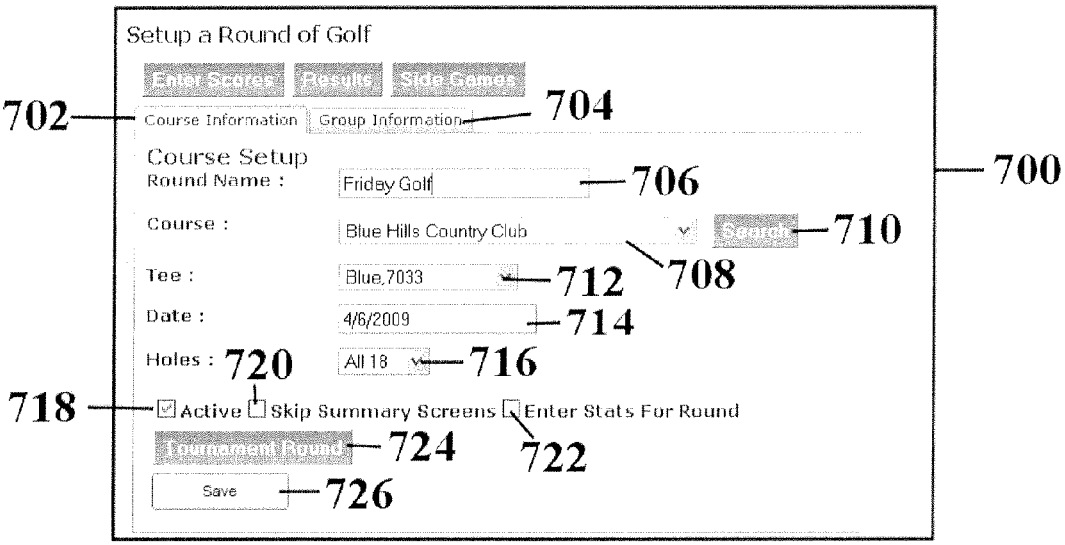
FIG. 7 is another exemplary screen display that may be displayed by some of the equipment of FIG. 1.

Once the user has logged in, he or she may select "My Game" and "Play a New Round" button or link 600 as shown in FIG. 6 and then be presented with a "Setup a Round of Golf" screen 700 such as the one shown in FIG. 7. This screen includes a "Course Information" tab or link 702 that permits the user to enter information about the golf course to be played and a "Group Information" tab or link 704 that permits the user to enter information about the players and/or groups of players for the round of golf.

FIG. 7 shows how the "Setup a Round of Golf" screen 700 looks if the "Course Information" tab or link 702 is selected. The screen may display a "Round Name" entry box 706 in which the user can enter an optional name for the round that may be helpful when later browsing through a list of previously played rounds. The screen may also include a "Course" drop-down menu 708 from which the user can select a golf course for the round. The "Course" drop-down menu 708 may list all of the user's favorite courses, all courses in a particular area, or any other golf courses. The screen may also include a "Search" button or link 710 that can be used to find a golf course that is not listed in the "Course" drop-down menu. Users also have the ability to add courses to the database of golf courses. They can add the physical address, name, scorecard information, etc. This can be done via the website or on the mobile phone at the time of play.

The screen 700 may also include a "Tee" drop-down menu 712 from which the user can select the tees for the round and a "Date" entry box 714 in which the user can enter the date for the round. The "Date" entry box defaults to the current day unless a different day is specified. The screen 700 may also include a "Holes" drop-down menu 716 from which the user can select the holes for the round (e.g. all 18, front 9, back 9). Users can create a tee on the fly with a mobile phone or website if a set of tees is not listed in the database.

The screen 700 may also include an "Active" box 718 that may be checked to include the round of golf in a Rounds list or unchecked to delete the round from the Rounds list. A "Skip Summary Screens" box 720 may be checked or unchecked to disable or enable, respectively, game summary screens in between holes. An "Enter Stats For Round" box 722 may be checked if the group wishes to enter and track statistics for the round of golf such as fairways hit, greens in regulation, number of putts, etc.

A "Tournament Round" button or link 724 may be checked to indicate the round is being played during a tournament or league. Clicking the "Tournament Round" button assigns a tournament ID number to the round so that other players and groups can join the round by entering the tournament ID number. Clicking the "Tournament Round" button also displays a "View Live Leader Board" button that may be selected to display a live leader board that periodically updates with live scoring results as players post scores while playing or after a round has been completed as described in more detail below. A "Save" button or link 726 may be pressed to save the data entered in the screen 700.

Figure 8:
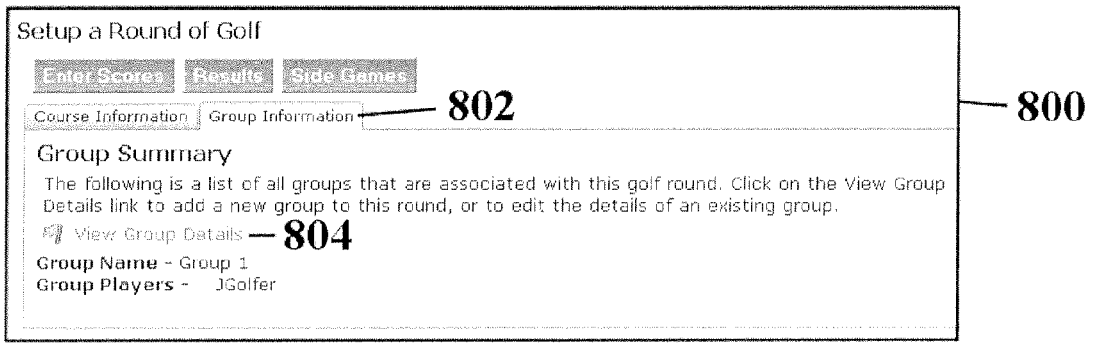
FIG. 8 is another exemplary screen display that may be displayed by some of the equipment of FIG. 1.

FIG. 8 shows a screen 800 that may be displayed if the "Group Information" tab or link (704 in FIG. 7, 802 in FIG. 8) is selected. This screen shows a summary of the group and players within the group. To display details of the group, or add new players or groups, a "View Group Details" button or link 804 may be selected to display a "Group Details" screen 900 such as the one shown in FIG. 9.

The "Group Details" screen 900 may include an "Add a New Group" button or link 902 to add a group for a round or multiple groups for a tournament or league. When this link is selected, a "Group Name" entry box 904 may be displayed for entry of a name for the new group, a "Starting Hole" entry box 906 may be displayed to select the starting hole for the group (defaults to hole 1), an "Enter Scores for This Group" button or link 908 may be selected to indicate that scores will be entered in scorecard format, and a "Remove This Group" button or link 910 may be selected to remove the group from the round.

The "Group Details" screen 900 permits players to be added to a group in three ways. First, players may be added by listing their user IDs in four fields or boxes 912 under a "Add Players to Group" heading. Second, players from a known list may be added by checking check boxes 914 next to a list of players' names under a "Friends List" heading. Any registered user may create a list of regular playing partners by logging onto www.golfstakes.com, selecting the "Friends" tab under "My Game," entering the user names of any other registered users, and then clicking on "Add Golfer." Players may be removed from a "Friends" list by selecting "Settings" by the user profile, choosing "Add/Remove Friends" under "Friends Management," and then clicking "Remove" on the right side of the person's name to remove that person. Third, a guest player (no user ID) may be added by selecting an "Add a One-Time Golfer" link 916. The "Add a One Time Golfer" will not have the ability to review the round at a later date because he or she does not have a user ID and password. All of the round information and side games will be stored for all players under each registered user's accounts.

As players are added to a group using any of the methods described above, their name will appear under the column "Golfer Name" 932. A "Playing Order" entry box 918 may be presented next to each player to select the order in which the player's scores will be entered. A "Tee" drop-down menu 920 may be used to select the tee for each player (defaults to the tee that was chosen in FIG. 7 above). An "Index" box 922 shows each player's handicap index, which is calculated based on the handicap index entered during account registration. The handicap index can also be manually changed, and if it is, the computer programs implementing the website automatically calculate the player's handicap for the tees that were chosen. Likewise, a "Handicap" box 924 shows each player's handicap, which is taken from the user's profile or is automatically calculated from the player's handicap index. Users also have the capability to have Golfstakes.com calculate their handicap index, and that calculated index will automatically update their user profile. This calculated index can also be used to determine the player's handicap based on the course and tees that were chosen.

A "Cart" box 926 may be used to pair partners together for side games, leagues, or tournaments. A "Remove" box 928 can be checked to remove a player from a group. Finally, a "Save Changes" button 930 can be selected to save all entered changes to the group.

Figure 9:
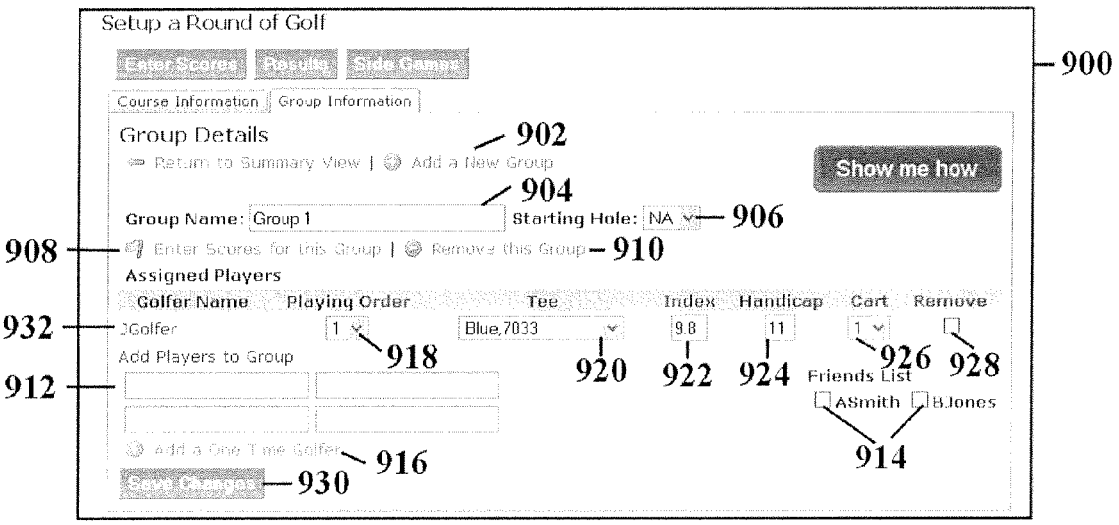
FIG. 9 is another exemplary screen display that may be displayed by some of the equipment of FIG. 1.
Figure 10:
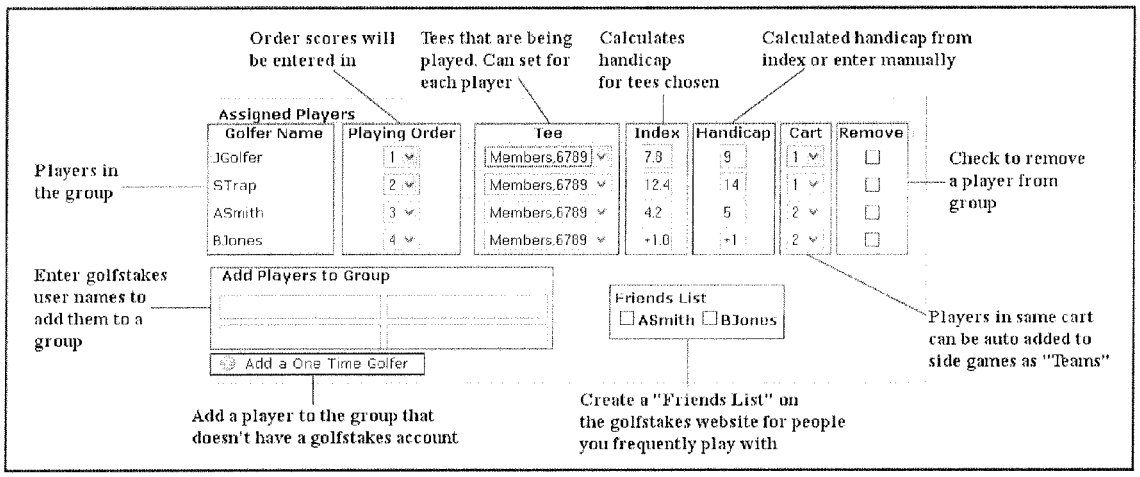
FIG. 10 is another exemplary screen display that may be displayed by some of the equipment of FIG. 1.

FIG. 10 shows a portion of the "Group Information" screen 900 of FIG. 9 after it has been populated with data for four players, with notes accompanying some of the fields.

Add Side Games

Once a golf round has been set up by entering the course information and group information as explained above, any number of side games can be added to the round. Side games may be added to a round at any time before, during, or after a round of golf is played and the host computer 12 will save, track, and score them as described in more detail below.

The computer programs operating the website can track and score any side games including Abilene, Best Ball, Bing-Bango-Bongo, Birdies, Chip Game, Custom Game, Daytona, Eagles, Match Play, Match Play 18, Nassau, Nine-Point, Point Play, Skins With Carryover, Skins Without Carryover, Sows, Stableford, Stroke Play, Stroke Match Play, and Train Wreck. These are only examples of side games that can be added to a round, as the host computer 12 and computer programs can be configured to track and score any side game. Moreover, the present invention can track and score side games for a single group and/or during league play or tournament play. There is no limit to the number of side games that can be added and tracked during a round of golf, or the number of player/game combinations. Side games can be created and tracked across multiple groups and up-to-date scoring can be viewed with any web-enabled cell phone. Players, teams, or groups can also be "auto-added" to side games if the "Auto-Add" feature is enabled when the side games are created as described herein. This is helpful if players and/or groups want to be added "on the fly" after the side games have already been set up.

Figure 11:
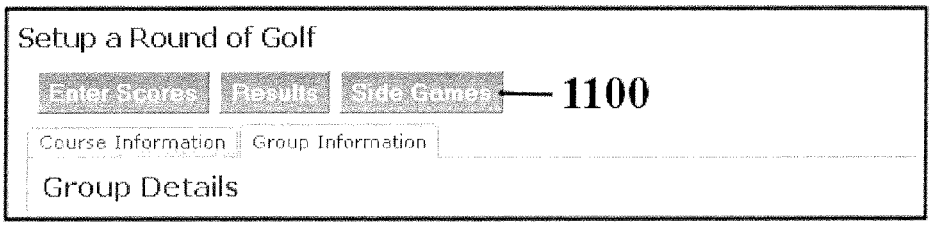
FIG. 11 is another exemplary screen display that may be displayed by some of the equipment of FIG. 1.
Figure 12:
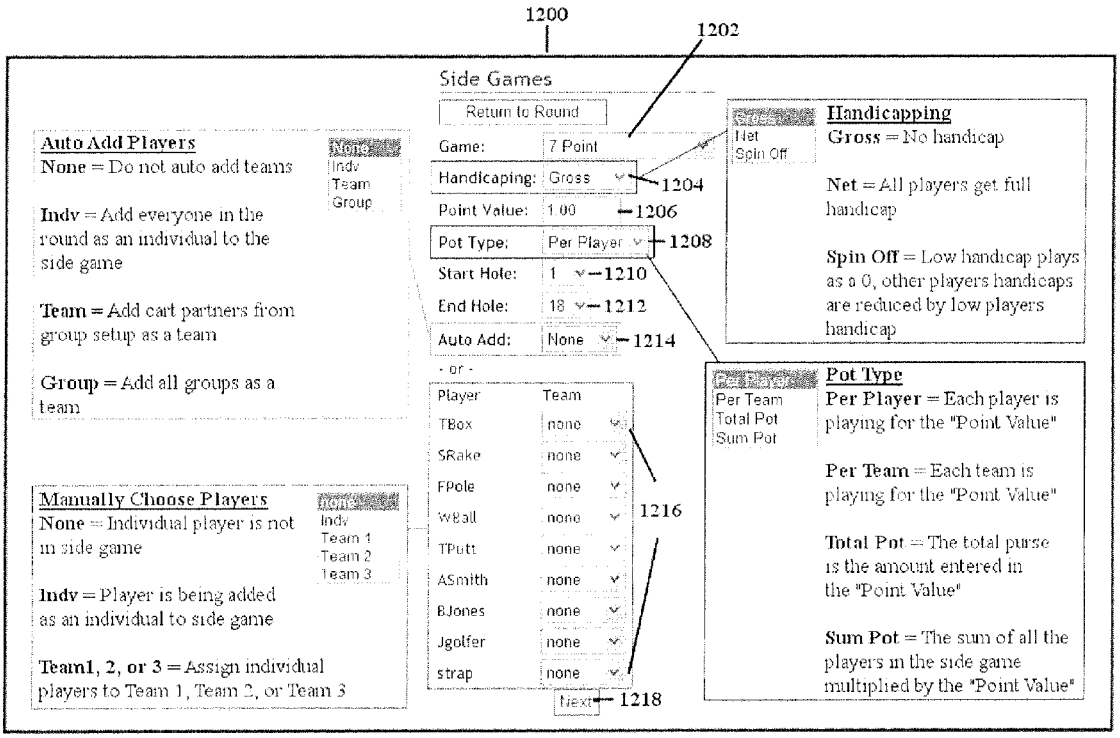
FIG. 12 is another exemplary screen display that may be displayed by some of the equipment of FIG. 1.
Figure 13:
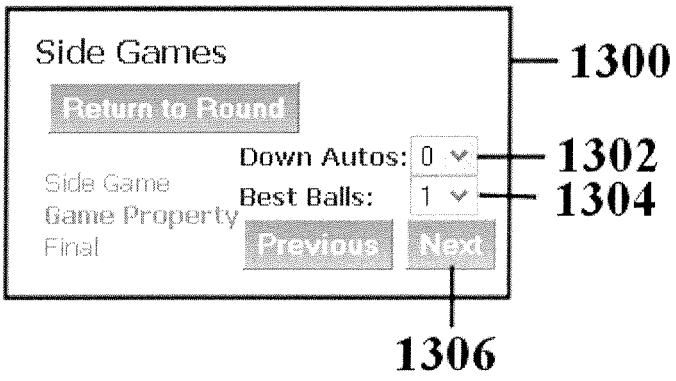
FIG. 13 is another exemplary screen display that may be displayed by some of the equipment of FIG. 1.

To add a side game to a round, a user may select a "Side Games" button or link 1100 such as the one shown in FIG. 11. This displays a Side Game Wizard or other screen that enables any player or other user to add games to a round and configure the players, teams, or groups. An exemplary Side Game Wizard 1200 is shown in FIG. 12 along with notes for certain fields. The Side Game Wizard may include a "Game" drop-down menu 1202 from which a side game may be selected. A "Handicapping" drop-down menu 1204 may be used to select between Gross Handicapping (no handicaps), Net Handicapping (all players get their full handicap), and Spinoff (low handicap plays as a zero and all other players' handicaps are reduced by the low player's handicap.)

A "Point Value" box 1206 may be used to select a point value for the side game, and a "Pot Type" drop-down menu 1208 permits selection between a Per Player Pot (each player is playing for the assigned point value), Per Team (each team is playing for the assigned point value), Total Pot (the total purse is the amount entered in the "Point Value" box, and Sum Pot (the sum of all the players in the side game multiplied by the assigned point value. A "Start Hole" box 1210 may be used to select the starting hole for a game, and an "End Hole" box 1212 may be used to select the ending hole for a game.

An "Auto Add" drop-down menu 1214 may be used to select between None (teams are not automatically added to the selected side game), Indv (everyone in the round is added as an individual to the side game), Team (cart partners are added as a team), and Group (all groups are added as a team). Instead of using the "Auto-Add" drop-down menu, each player may be manually added to a side game. For example, a drop-down menu 1216 may be shown next to each player and permits selection between None (player not added to the side game), Indv (player is added as an individual), Team 1 (the player is assigned as an individual to a first team), Team 2 (the player is assigned as an individual to a second team), and Team 3 (the player is assigned as an individual to a third team). Although three teams are shown, the website may support any number of teams. After all of the desired selections are made in FIG. 12, a "Next" button 1218 may be selected to save the side game configurations.

Additional Side Game Wizard screens may be displayed for some side games that have additional game properties. For example, a screen 1300 such as the one shown in FIG. 13 may be displayed when a Match Play side game is chosen. This screen includes a "Down Autos" drop-down menu 1302 to select the number of holes a player must be down before a new side game or press is added, and a "Best Balls" drop-down menu 1304 to select the number of scores to count from the team for the side game. After these selections have been made, a "Next" button 1306 may be selected to save the settings.

Figure 14:
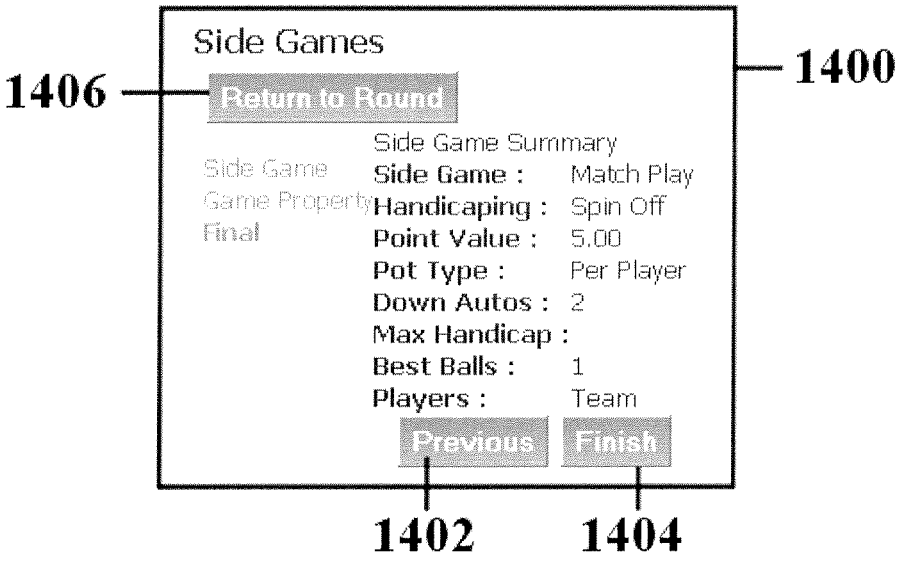
FIG. 14 is another exemplary screen display that may be displayed by some of the equipment of FIG. 1.

FIG. 14 shows an additional Side Game Wizard screen 1400 that summarizes an added side game. If the user notices a mistake or omission, a "Previous" button 1402 can be selected to return to one of the previous screens to make corrections or additions. A "Finish" button 1404 may be selected to add the game to the round.

Optionally, a registered user can create "Side Game Favorites" under their user profile. The user can go to the website and choose the games that he or she would like to be added to each round automatically, and how the teams will be assigned based on the number of players in the group. For example, in a threesome, the player may want to play 9 point, with spin off handicapping, and add all players as individuals. In a foursome, the player may want to play a 5 point match play with spin off handicapping and 2 down autos. Players in cart 1 will verse players in cart 2. The player may also want to play a skins game for 5 points with spin off handicapping and auto add all players. In a fivesome, the player may want 3-5 point match play games with spin off handicapping and 2 down autos. Players 1-2 will be partners in all games versus players 3-4, players 3-5, and players 4-5.

The above-described procedure may be repeated for any number of side games. After all desired side games have been added, the user may select "Save" to save their "Side Game Favorites". When this user creates a round, the host computer will automatically add side games from the "Side Game Favorites" to the round based on the number of players in the group and will also determine who playing partners are by the way the players were added to the group and configured in the "Side Game Favorites."

Entering Scores

If a golf round is scored and any of the players within the group have a Golfstakes.com user ID, all scores, scoring statistics, and side game information will be updated for each Golfstakes.com user ID in the group regardless of which user ID scores the round. For example, if a foursome plays golf and the four players in the group all have Golfstakes.com user IDs, any one of those players can score the round and the present invention will update all the round, scores, and side game information for all of the Golfstakes.com user IDs in the group.

Figure 15:
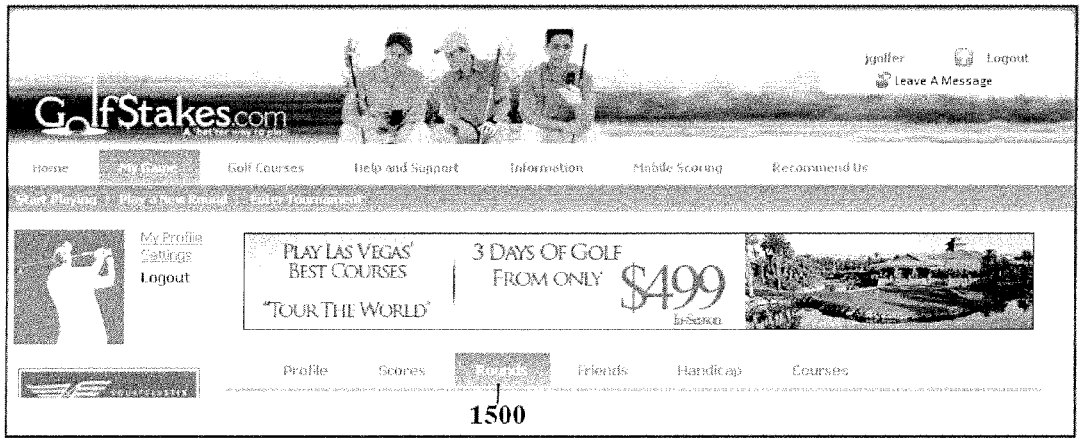
FIG. 15 is another exemplary screen display that may be displayed by some of the equipment of FIG. 1.
Figure 16:
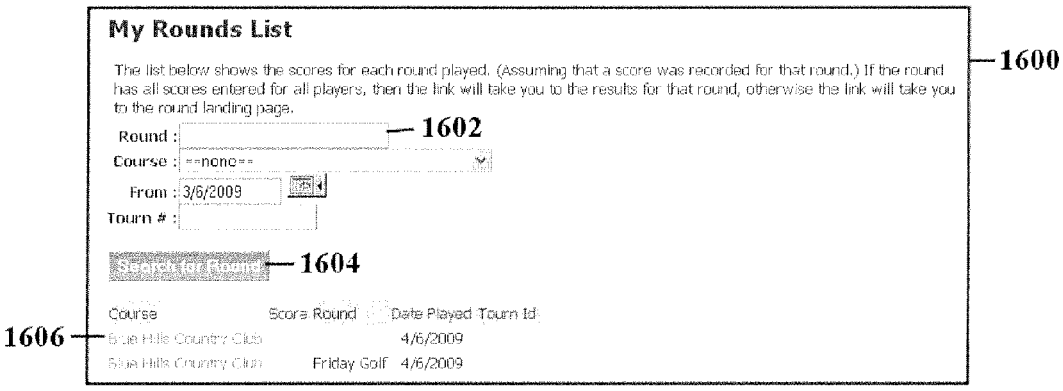
FIG. 16 is another exemplary screen display that may be displayed by some of the equipment of FIG. 1.

To score a round of golf after it has been played, any of the players or any other user may use one of the devices 18-28 to log-in to Golfstakes.com website and then click on "Rounds" tab 1500 under the "My Game" menu as shown in FIG. 15. A "My Rounds List" screen 1600 such as the one in FIG. 16 may then be displayed to permit the user to select a particular saved round. This screen may include a "Round" box 1602 that lists all saved rounds and a search function 1604 that may be used to search for a round that is not displayed. Once the desired round is found and displayed at the bottom of the screen, the user may click on the course name 1606 to proceed with scoring the round.

Figure 17:
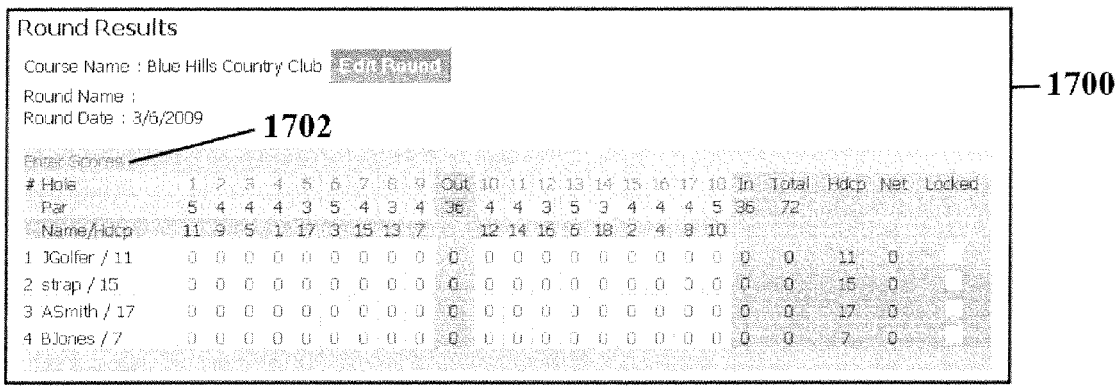
FIG. 17 is another exemplary screen display that may be displayed by some of the equipment of FIG. 1.
Figure 18:
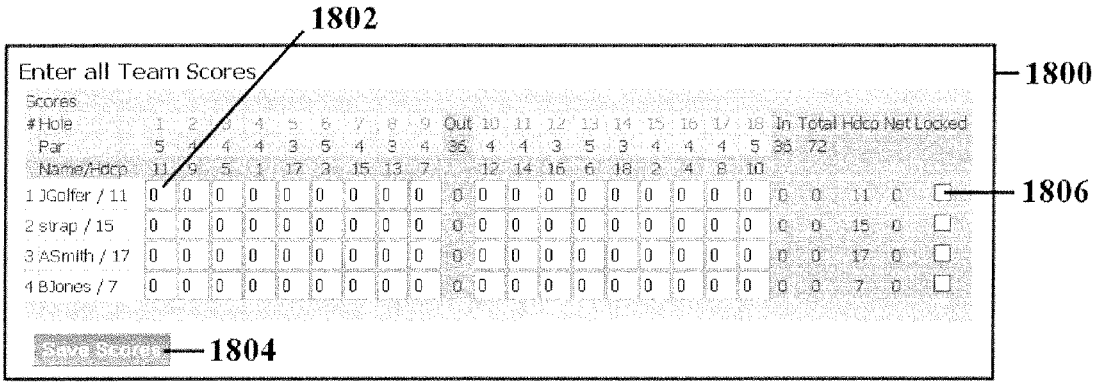
FIG. 18 is another exemplary screen display that may be displayed by some of the equipment of FIG. 1.

A simulated scorecard 1700 such as the one shown in FIG. 17 may then be displayed. An "Enter Scores" button or link 1702 may be selected to display another simulated scorecard 1800 such as the one shown in FIG. 18 that includes entry boxes 1802 next to each player for every hole in the round. Once all of the scores have been entered in all of the entry boxes, a "Save Scores" button 1804 may be selected to save the scores. This screen may also include "Locked" entry boxes 1806 that may be checked to indicate that scores have been verified. Once the "Locked" option has been set, the players' scores cannot be adjusted unless the lock is removed. To remove the lock, the user may choose "Enter Scores" from the screen in FIG. 17, uncheck the lock, and choose "Save Scores" to re-enter the scores in the same manner as described above.

A user may also choose a particular group from the group listing and only enter scores for that group. So instead of using the "Enter Scores" for the entire field, a user can enter scores for just a particular group if he chooses.

When a round has been scored as described above, the computer programs implementing the website automatically calculate each player's total score for the round and results for all of the side games that were added to the round. A "Side Game Summary" screen 1900 such as the one shown in FIG. 19 may then be displayed to summarize all of the results of the side games. Specifically, the "Side Game Summary" screen 1900 may show every player's score, how many points each player won or lost for the round, details of each individual game with a tally for each game per player, as well as a grand total for the round. A separate scorecard may also be displayed for each individual game. A "Show-Details" button or link 1902 may be selected to show each player's net score for every hole and details of how the game was calculated, an example of which is shown at the bottom of FIG. 19.

Figure 20:
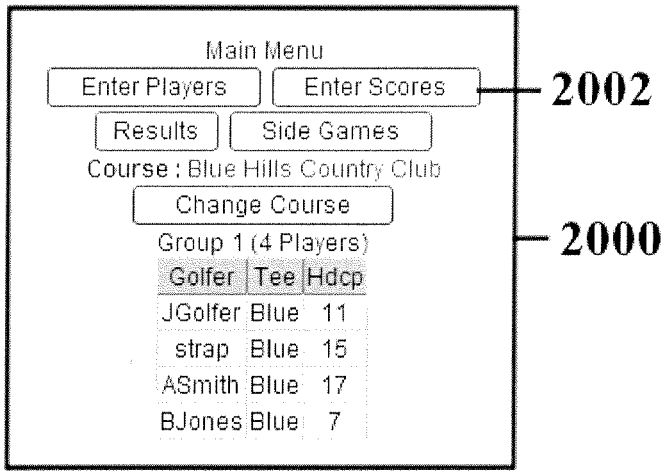
FIG. 20 is another exemplary screen display that may be displayed by some of the equipment of FIG. 1.

A user may also score a round of golf with one of the mobile devices 18,20,22 while playing. To do so, the user may access the host computer 12 by navigating to m.golfstakes.com (or any other URL that points to the host computer) and then selecting the "Create Round" link or similar button from the "Main Menu". A screen 2000 such as shown in FIG. 20 may then be displayed where the player can choose which course will be played, along with tees, holes, and a description of the round if desired. The player may then add players to a group by selecting "Next". Once the group or groups have been added, any number of side games may be added by selecting "Next". Once all side games have been configured/added, the player may select "Return to Round" or similar button. Alternatively, if the round was created via the website, the player may then access the round by choosing the golf course link in the "Course" section under the "Today's Rounds." A screen 2000 such as the one shown in FIG. 20 may then displayed to summarize the course, the players/groups, the tees and the handicaps for the round. After the user has verified that the course, players, and other details are correct and made any needed corrections, the user may select an "Enter Scores" button 2002 to begin entering scores for the round.

Figure 21:
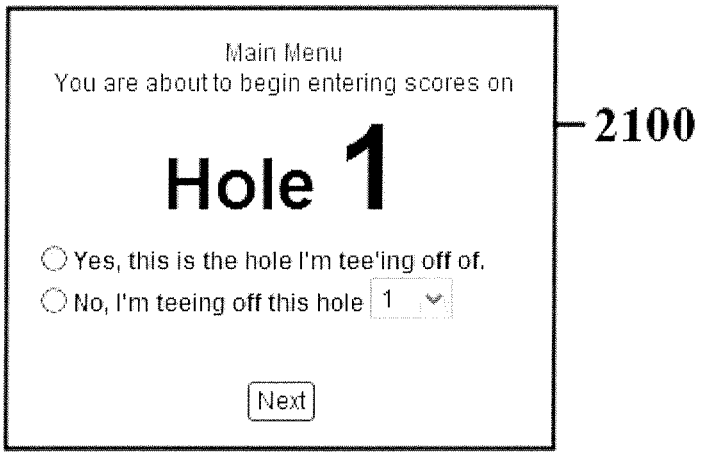
FIG. 21 is another exemplary screen display that may be displayed by some of the equipment of FIG. 1.

A screen 2100 such as the one shown in FIG. 21 may then be displayed to verify that the players are beginning on the proper starting hole. If the players are not starting on the starting hole that was selected during the round set-up, they may select a different one from a drop-down menu.

Figure 22:
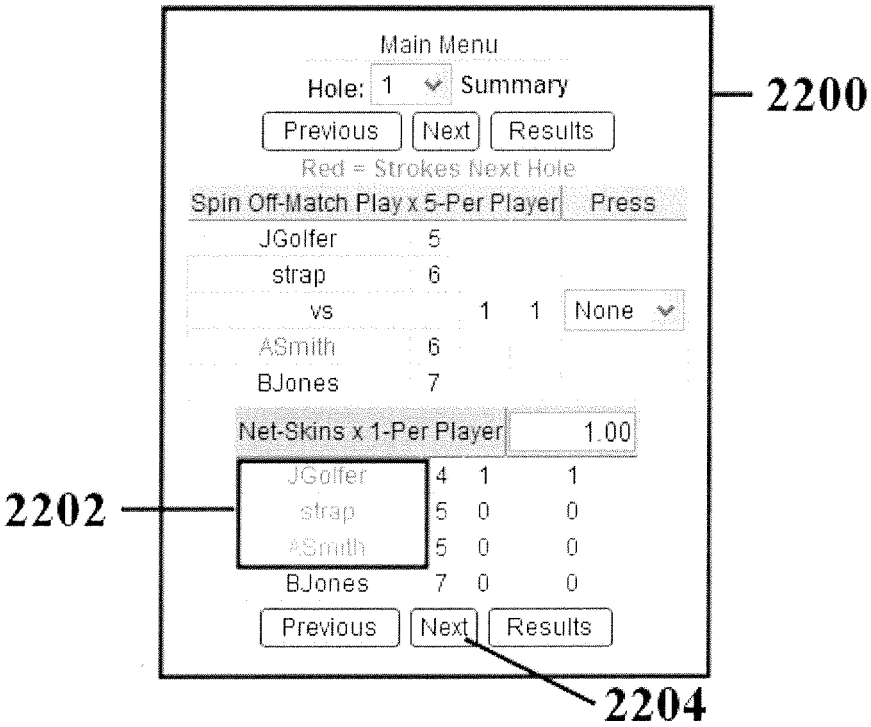
FIG. 22 is another exemplary screen display that may be displayed by some of the equipment of FIG. 1.
Figure 23:
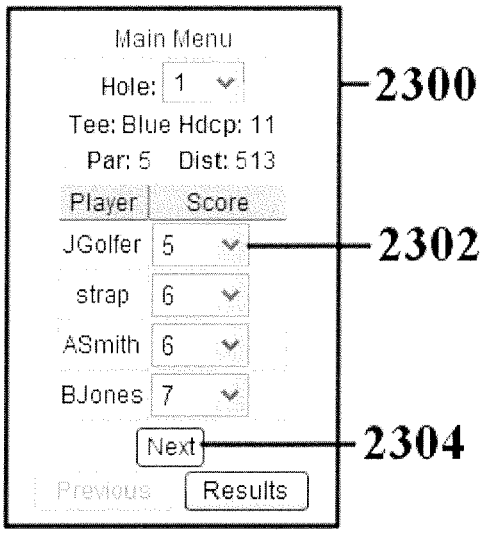
FIG. 23 is another exemplary screen display that may be displayed by some of the equipment of FIG. 1.

The website may also show a side game summary screen 2200 such as the one shown in FIG. 22 on the first hole so that the players can see who has strokes for each side game. Players listed in red (inside square box 2202) or otherwise marked will receive a stroke on a hole for a particular side game. Players that are listed in red and followed by an asterisk receive two strokes on the hole. FIG. 22 indicates that there are no strokes in the match play game because the handicapping was set to "Spinoff." In the illustrated Skins game, three players receive a stroke on the first hole because the handicapping was set to "Net."

The scorer may then select a "Next" button 2204 to continue scoring the hole. A screen 2300 such as the one shown in FIG. 23 may then be displayed. This screen 2300 lists each of the players next to a scoring box 2302 for entering each player's score on the hole. When all scores have been entered, a "Next" 2304 button may be selected to proceed to the next hole.

As scores are being entered and any time thereafter, users may access the host computer 12 via any of the devices 18-28 and view a simulated "Leader Board" such as the one shown in FIG. 25. The Leader Board shows up-to-date results of a golf round and side games for any group or multiple groups and may include any of the information in the other attached screen shots. The Leader Board and/or other screens displayed by the website may permit entry and display of comments so that players may post messages about scores as they are entered.

Other Features

The website of the host computer may 12 also display useful information and advertising in connection with a round of golf. For example, when a golf course is selected for a round of golf as discussed above, amenities for the course may be displayed such as list of restaurants, bars, meeting rooms, etc. Users may also rate courses and enter information about selected holes, and the information may be displayed by the host computer.

The host computer 12 may also provide automatic recommendations based on entered information. For example, side games may be recommended based on the handicaps of the players in a group or the identity of the players; playing partners may be recommended for a group based on a common interest in a particular side game; a particular course may be recommended based on the players' handicaps or selected side games; and side games may be recommended to a user based on that user's past victories/losses against other players in the group.

The website may also track player statistics such as fairways in regulation (FIR), greens hit in regulation (GIR), number of putts, number of sand saves, number of penalty strokes, etc. For example, the website may provide a screen 2400 such as the one shown in FIG. 24 that shows how many birdies, pars, bogeys, etc. a player made during any selected time frame. The illustrated screen 2400 shows that the player 5 birdies, 14 pars, 15 bogeys, 8 double bogeys, and 3 quadruple bogeys between Feb. 5, 2009 and Apr. 6, 2009. The player may click on any of the score types and obtain the course name, date, hole number, and other information for each of the scores. The illustrated screen lists details for all of the player's birdies.

The computer programs of the website may also suggest a club to use based on the distance from a hole and past hitting statistics. The website may permit a player to choose a course or courses, select a date range, and then obtain the player's average score per hole, percentage of the times the player has parred the hole, average percent of win/loss for each hole, and other statistics.

The website may also show each player's average score, percentage of times each player has parred the hole, on each hole as a round is played.

The invention may also track every user's earning/losses over time, both cumulatively and against other particular users. The invention may then use this historical information to predict expected scores and side game results against players for future rounds.

Users may also create Virtual Golf Associations (VGAs) and choose how they want to calculate handicaps for every member player. For example, a VGA may allow users to select the number of rounds to consider for handicaps, the weighting of scores, which scores count for handicapping (e.g. a 3-handicap golfer may be prevented from posting a score of 8 or higher on a hole). The website may also support a fantasy golf league using registered users as the players in the fantasy league rather than professional players.

A league administrator may also send a blast email to Golfstakes members based on them having a particular course listed in their course favorites, having ever played the course, or having played surrounding courses that they choose. The invention may also analyze entered zip codes, city, state, etc. to select potential members of a league created for a particular golf course. Players would then be able to click on a link in an email to join the league. The league administrator can remove any player from the league and/or add any player to the league.

The website also has the ability to create multi-day rounds. For example, a user may create an outing consisting of three rounds and be able to choose which rounds to include in the multi-round outing. The website also has the ability to create flights within the round. This will place players with similar handicaps in the same flights.

A user may also choose an AUTO GROUP option that will pair players/or teams into groups for playing. A user may also manually reconfigure players/groups/flights/playing groupings even if the AUTO GROUP feature was used.

The invention also permits users to print scorecards for league/tournament with players on team/group and shows where players strokes fall on each hole, previous scores if multi-round, any adjustments that may have been made to their final score and their total score to this point after adjustment. A user may also print a summary sheet that goes in each cart to show what players are in cart and what hole they start on.

The electronic or printed scorecard may show the team/player adjustment that the player/team will be assessed at the end of the round. For example, when scores are adjusted off of a score of 66, and the team shoots a 62, their adjustment the following day in round 2 will be a +2. This was determined by taking the score of 66−62=4/2=2. The website may also have a wizard that the league or tournament director will be able to use to create the rules.

Each created tournament may have an ID code so that any player can enter the ID and join the tournament if slots are available to join. An administrator may have the ability to limit the size of the field for a tournament/league. The website may also permit a golf course to list upcoming events/tournaments and allow players to register via the website.

A user may also combine players/teams/groups into a super group or super team. The website may also support an auction for super teams and show a super team LIVE broadcast (TV, Laptop, Projector) for the points a team sold for and point payouts for each day. If a team has not been purchased yet, the amount the first team was sold for may be listed next to each unsold team so players can see payout amounts. The website permits an administrator or tournament director to select a percentage of the team sales for a commission. For example, a tournament director could enter 2,000 points as the amount the team sold for. The website would post 2,000 points next to the team, but behind the scenes it will calculate a payout off of sales price−commission. If a commission of 10% was entered, the payout would be calculated off of 2000 points−200 point commission for a total of 1,800 points. The commission can be determined by the administrator or tournament director as either a flat rate or percentage of the sale. The website provides the ability to specify which rounds payouts will be made on, or which side games, and/or the ability to combine multiple rounds together to include an overall summary of all rounds and that a payout will occur.

The website may provide the ability to take predictions on a player/team within tournament/league and predictions on players within a flight and show live odds as predictions are placed. The website may provide the ability to specify that everything collected within the flight is the payout or can combine all flights for payout winnings. A paper ticket may be created by the website and given to the player to show which team/player was selected. The ticket may have a bar code and/or a unique number on it so players will know which ticket wins. The website may also provide the ability to predict winners on a player/team with pari-mutual odds and calculate win/place/show.

The invention may also allow golf courses to create a query of Golfstakes members for a newsletter. A golf course may choose players that have a specific course listed in course favorites or may choose players based on courses that they have played. This will generate a query that will give instant feedback to the golf course to show how many members will receive the email/newsletter. Course will be able to choose what type of mailing they are sending such as a Course News, League Info, Tournament Info, Specials, etc. Golfstakes members will have the ability to opt out of receiving mailings from a particular golf course. Members will be able to choose which mailings they want to receive, or opt out of all.

Advertisers may be given the ability to create email advertisements and mobile advertisements on the website. The mobile ads may be displayed on players' cell phones while golfing.

"Send Me Info" or "Next" may be displayed at the bottom of the mobile ads. "Next" returns to normal scoring. "Send Me Info" sends an e-mail advertisement that the advertiser created with the website to user's email address behind the scenes, and returns the user to normal scoring not interrupting scoring of the golf round. Users may also have the ability to pay for a premium non-advertisement version of the software.

Although the invention has been described with reference to exemplary embodiments illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A non-transitory computer readable medium having a computer program stored thereon for operating a computer system to track golf scores and side games, the computer program comprising:

a first code segment for receiving with the computer system course information and player information for a round of golf having a number of holes which complete the round of golf, including bet information and information indicating which players in a group of players are partners;

a second code segment for receiving with the computer system side game favorites information as part of a user profile, the side game favorites information indicating which side games the user would like to be automatically created and added to each round of golf and how teams are automatically assigned in each side game based on a number of players in the group and which of the players in the group of players are partners;

a third code segment for receiving with the computer system before the round of golf first side game information for a first side game to be played by the players of the round of golf, the first side game information including a selection by a user of a number of holes a player must be down in the first side game before a new press is added for the first side game;

a fourth code segment for receiving with the computer system during the round of golf second side game information for a second side game to be played by the players of the round of golf, the second side game information including a second selection by the user of a second number of holes the player must be down in the second side game before a second new press is added for the second side game;

a fifth code segment for receiving with the computer system after the round of golf having been completed third side game information for a third side game played by the players of the round of golf having been completed;

a sixth code segment for automatically adding a fourth side game to the round of golf with the computer system, the fourth side game corresponding to the side game favorites information;

a seventh code segment for receiving with the computer system scoring information for the players, an eighth code segment for scoring with the computer system the round of golf and calculating results of the first, second, third, and fourth side games based at least partially on the player information and the scoring information, and a ninth code segment for tracking each of the players earnings and losses, both cumulatively and against other individual players, based at least partially on the player information and the scoring information.

2. The computer readable medium as set forth in claim 1, further including a code segment for displaying on a display device in communication with the computer system data representative of the scoring information and the results of the side games.

3. The computer readable medium as set forth in claim 1, wherein the computer system includes a computer that may be accessed by the Internet and all the code segments implement a website hosted by the computer system.

4. The computer readable medium as set forth in claim 3, wherein the scoring information is received from a mobile phone that accesses the website via the Internet.

5. The computer readable medium as set forth in claim 1, further including a tenth code segment for displaying on a display device in communication with the computer system a simulated leader board that shows the scoring information for each of the players as the scoring information is received.

6. The computer readable medium as set forth in claim 1, wherein the course information includes data representative of a name of a golf course where the round of golf is to be played, a set of tees to be played from, and the number of holes to be played for the round of golf.

7. The computer readable medium as set forth in claim 1, wherein the player information includes data representative of each of the player's name, handicap, and handicap index.

8. The computer readable medium as set forth in claim 1, wherein the first and second side game information includes data representative of a name of at least one side game to be played by at least some of the players, an indication of which of the players are playing the side game, a starting hole for the at least one side game, and an ending hole for the at least one side game.

9. A computer-implemented method of tracking golf scores and side games, the method comprising:

receiving with a computer system course information and player information for a round of golf having a number of holes which complete the round of golf, including bet information and information indicating which players in a group of players are partners;

receiving with a computer system side game favorites information as part of a user profile, the side game favorites information indicating; which side games the user would like to be automatically created and added to each round of golf and how teams are automatically assigned in each side game based on a number of players in the group and which of the players in the group of players are partners;

receiving with the computer system before the round of golf first side game information for a first side game to be played by the players of the round of golf, the first side name information including a selection by a user of a number of holes a player must be down in the first side game before a new press is added for the first side game;

receiving; with the computer system during; the round of golf second side game information for a second side game to be played by the players of the round of golf, the second side game information including a second selection by the user of a second number of holes the player must be down in the second side game before a second new press is added for the second side game;

receiving with the computer system after the round of golf having been completed third side game information for a third side game played by the players of the round of golf having been completed;

automatically adding; a fourth side game to the round of golf with the computer system, the fourth side name corresponding; to the side name favorites information;

receiving with the computer system scoring information for the players as they play the round of golf;

scoring with the computer system the round of golf and calculating results of the first, second, third, and fourth side games based at least partially on the player information and the scoring information; and tracking each of the players earnings and losses, both cumulatively and against other individual players, based at least partially on the player information and the scoring information.

10. The method as set forth in claim 9, wherein the scoring information is received from a mobile phone operated by one of the players during the round of golf.

11. The method as set forth in claim 9, further including a code segment for displaying on a display device in communication with the computer system data representative of the scoring information and the results of the side games.

12. The method as set forth in claim 9, wherein the computer system includes a computer that may be accessed by the Internet and all the method steps implement a website hosted by the computer system.

13. The method as set forth in claim 12, wherein the scoring information is received from a mobile phone that accesses the website via the Internet.

14. The method as set forth in claim 9, further including a step for displaying on a display device in communication with the computer system a simulated leader board that shows the scoring information for each of the players as the scoring information is received.

15. The method as set forth in claim 9, wherein the course information includes data representative of a name of a golf course where the round of golf is to be played, a set of tees to be played from, and the number of holes to be played for the round of golf.

16. The method as set forth in claim 9, wherein the player information includes data representative of each of the players name, handicap, and handicap index.

17. The method as set forth in claim 9, wherein the first and second side game information includes data representative of a name of at least one side game to be played by at least some of the players, an indication of which of the players are playing the side game, a starting hole for the at least one side game, and an ending hole for the at least one side game.

18. A system for tracking golf scores and side games, the system comprising:

a first means for receiving with a computer system course information and player information for a round of golf having a number of holes which complete the round of golf, including bet information and information indicating which players in a group of players are partners;

a second means for receiving with the computer system side game favorites information as part of a user profile, the side game favorites information indicating which side games the user would like to be automatically created and added to each round of golf and how teams are automatically assigned in each side game based on a number of players in the group and which of the players in the group are partners;

a third means for receiving with the computer system before the round of golf first side game information for a first side game to be played by the players of the round of golf, the first side game information including a selection by a user of a number of holes a player must be down in the first side game before a new press is added for the first side game;

a fourth means for receiving with the computer system during the round of golf second side game information for a second side game to be played by the players of the round of golf, the second side game information including a second selection by the user of a second number of holes the player must be down in the second side game before a second new press is added for the second side game;

a fifth means for receiving with the computer system after the round of golf having been completed third side game information for a third side game played by the players of the round of golf having been completed;

a sixth means for automatically adding a fourth side game to the round of golf with the computer system, the fourth side game corresponding to the side game favorites information;

a seventh means for receiving with the computer system scoring information for the players as they play the round of golf;

an eighth means for scoring with the computer system the round of golf and calculating results of the first, second, third, and fourth side games based at least partially on the player information and the scoring information; and a ninth means for tracking each of the player's earnings and losses, both cumulatively and against other individual players, based at least partially on the player information and the scoring information.

19. The computer readable medium as set forth in claim 1, further including a code segment for receiving revised bet information and for updating each of the player's earnings and losses, both cumulatively and against other individual players, based at least partially on the revised bet information.

20. The method as set forth in claim 9, further comprising receiving revised bet information and updating each of the player's earnings and losses, both cumulatively and against other individual players, based at least partially on the revised bet information.

* * * * *